United States Patent [19]

Schwer

[11] Patent Number: 4,526,349

[45] Date of Patent: Jul. 2, 1985

[54] METHOD AND ARTICLE OF MANUFACTURE FOR CONTROLLING SLAG CARRY-OVER DURING TAPPING OF A HEAT IN STEELMAKING

[76] Inventor: John W. Schwer, 1349 Azalea Dr., Munster, Ind. 46321

[21] Appl. No.: 560,918

[22] Filed: Dec. 13, 1983

[51] Int. Cl.[3] ..... B22D 41/10

[52] U.S. Cl. ..... 266/45; 266/227; 266/272

[58] Field of Search ..... 266/45, 230, 44, 227, 266/236, 272, 271

[56] References Cited

U.S. PATENT DOCUMENTS 3,934,755 1/1976 Rheinlander et al. ..... 266/230

FOREIGN PATENT DOCUMENTS 7022602 6/1977 Japan ..... 266/227

0042305 4/1979 Japan ..... 266/45

*Primary Examiner*—L. Dewayne Rutledge

*Assistant Examiner*—S. Kastler

*Attorney, Agent, or Firm*—Jones, Day, Reavis & Pogue

[57] ABSTRACT

A steelmaking process and an article of manufacture for use therein, comprising the addition to the steelmaking vessel or caster tundish prior to the tapping of the finished steel of a heat-stable material having a density such that said material floats substantially at the interface between the slag and steel, said material being in the physical form of at least one annular disc. The heat-stable material may also be added to the vessel in the physical form of at least one discrete piece in addition to the annular disc.

5 Claims, 5 Drawing Figures

METHOD AND ARTICLE OF MANUFACTURE FOR CONTROLLING SLAG CARRY-OVER DURING TAPPING OF A HEAT IN STEELMAKING

BACKGROUND OF THE INVENTION

1. Field of the Invention

The invention relates generally to steelmaking, particularly to the production of steel in side-tapped vessels.

2. Description of the Prior Art

The production of steel in substantially cylindrical vessels has been practiced since the inception of the Bessemer process in the mid-1800's. The steelmaking process has remained essentially unchanged in its major steps to date, although advances such as the basic oxygen furnace have been made.

One of the key steps in steelmaking is the formation of a layer of molten slag, which is necessary to the chemical conversion of the molten pig iron to steel, particularly with respect to the removal of impurities from the charged materials. The slag comprises a molten liquid having a lower density than the steel, such that it floats on the molten steel as an essentially unitary layer. On the completion of the heat, it is necessary to separate the slag layer from the steel. The less slag which is left on the liquid steel, the higher the overall purity of the steel products (bar, billet and the like) which will result on casting.

In substantially cylindrical steelmaking vessels, two alternatives were known for removing the molten materials, slag and steel, at the completion of the heat. The simplest was to turn or tilt the vessel, which is usually mounted on trunions to facilitate charging and discharging of materials, so as to pour the molten materials over the lip. The slag/steel density difference allows the pouring-off of the slag first, followed by the steel, if the steelmaker can control the progressive tilt of the vessel with sufficient accuracy to provide a slow, steady stream of molten material.

This technique presented numerous difficulties. The appropriate tilt to result in substantially complete slag removal before discharge of steel was almost impossible to control, particularly with respect to consistently attaining the same flow and separation. Too much tilt resulted in too rapid a flow, producing turbulence and the intermingling of the slag and steel, with the result of wasted steel removed with the slag and impure steel remaining in the vessel. Furthermore, pouring over the lip of the vessel was deleterious to the vessel and its internal refractory lining. The stream of molten material was also difficult to control, as slag and steel would build up on the vessel lip.

The second alternative, which is the most followed in the steelmaking art in tapping a substantially cylindrical steelmaking vessel, utilized a taphole in the side wall of the vessel. The taphole is closed during the course of the heat.

On completion of the heat, the vessel was tilted on its trunions until the slag-steel layer boundary contacted the side wall on which the taphole was mounted at a point substantially above the upper edge of the taphole. The taphole was then opened and the steel removed from below the slag layer, which continued to float on the molten steel. The steel was removed by progressively tilting the vessel until slag started to flow out of the taphole, at which time the tapping was stopped.

This second alternative also resulted in difficulties. The degree and progression of tilt was once again difficult to control. Too rapid a flow again resulted in turbulence, the intermingling of the slag and steel, and the attendant waste and impurity problems. The deliberate continuation of tapping until slag began to be discharged from the vessel presented the problem of having to remove that slag by skimming or other methods from every heat tapped.

To attempt to alleviate the difficulties with the taphole procedure, the steelmaking art developed the improvement to the tapping procedure of adding at least one discrete, usually spherically-shaped piece of a heat-stable material having a density such that it floated substantially at the slag-steel interface, to the vessel prior to the onset of tapping. When the majority of the molten steel was removed from the vessel on tapping, a sphere of the heat-stable material would flow towards and block off the taphole, allowing only a slight amount of slag into the tapped steel.

Even with this improvement, however, a serious difficulty remained. The taphole in the substantially cylindrical steelmaking vessels was round. When liquid is drained through a round hole, a vortex is generated which often extends well into the liquid. Control of the formation of a vortex was found to be extremely difficult in tapping steelmaking vessels.

Minimal vortexing could be assured only by a very slow tapping rate, which resulted in poor heat cycle time and overcooling of the steel during tapping. When the heat-stable material was used, even minimal vortexing posed the threat of drawing in the discrete piece and closing off the taphole prematurely, leaving too much untapped steel in the vessel, particularly as the vortexing increases as the overall depth of the liquid layer decreases. Attainment of a satisfactory cycle time thus required the tapping to take place at a rate which resulted in more than minimal vortexing and the leaving in the vessel of essentially all of the slag together with a substantial quantity of steel.

Despite the improvements to controlling slag carry-over during tapping, then, the problem of vortexing remained, and in fact helped turn the improvement of use of at least one discrete piece of heat-stable material into the source of yet another problem to the steelmaker.

SUMMARY OF THE INVENTION

The invention provides a solution to the vortexing and above-noted related problems in tapping a steelmaking vessel through a taphole by providing a steelmaking process comprising the addition to said vessel prior to tapping of a heat-stable material having a density such that said material floats substantially at the interface between the slag and steel layers existing at the completion of the heat, said material being in the physical form of at least one annular disc. The invention further provides, as an article of manufacture, an annular disc of heat-stable material for use in such process, said annular disc having a density such that said disc floats substantially at the interface between the liquid slag and liquid steel in a steelmaking vessel prior to tapping.

The annular disc of the invention may be used with or without at least one discrete piece of said heat-stable material, as is known in the steelmaking art.

It is therefore an object of the invention to provide an improvement in a steelmaking process in which a layer of liquid slag is formed on the liquid steel in the steelmaking vessel during said process, whereafter at the completion of the heat the liquid steel is removed from the vessel through a taphole, which prevents intermingling of the steel and slag, while providing rapid tapping capability and acceptable heat cycles.

It is another object of the invention to provide an article of manufacture which, when used in a steelmaking process in whioh steel is withdrawn from a steelmaking vessel at the completion of a heat through a taphole, substantially prevents vortex-induced intermingling of the steel to be recovered with the process slag.

Other objects and advantages of this invention will become apparent upon reading the following detailed description and appended claims.

DESCRIPTION OF THE PREFERRED EMBODIMENT

The preferred embodiment of the invention comprises the improvement, in a steelmaking process in which a layer of liquid slag is formed on the liquid steel in the steelmaking vessel during said process, whereafter at the completion of the heat said liquid steel is removed from said vessel through a taphole, of adding to said vessel prior to or during tapping, a heat-stable material having a density such that said material floats substantially at the interface between the slag and the steel, the material being in the physical form of at least one annular disc.

The annular disc may be utilized in any steel-making furnace or tundish in which a taphole is used to remove finished molten steel while effecting slag separation. It is particularly effective in substantially cylindrical furnaces such as are used in basic oxygen steelmaking, in electric arc furnaces, and in caster tundishes.

The preferred article of manufacture of the invention consists of an annular disc of heat-stable material having a density such that said disc floats substantially at the interface between the liquid slag and the liquid steel. The disc is most preferably toroidal in shape. The material used to produce the discrete pieces now used and known to the art may be used to fabricate the annular disc of the invention.

The optimum embodiment of the improved process of the invention combines the use of at least one of the refractory annular discs of the invention in combination with at least one discrete piece, preferably spherical in shape, of the heat-stable material having the appropriate density. The discrete spherical piece is dimensioned so as to fit witin the open center of the annular disc, leaving an annular passage for steel flow, yet being of a diameter larger than that of the taphole.

Figure 1:
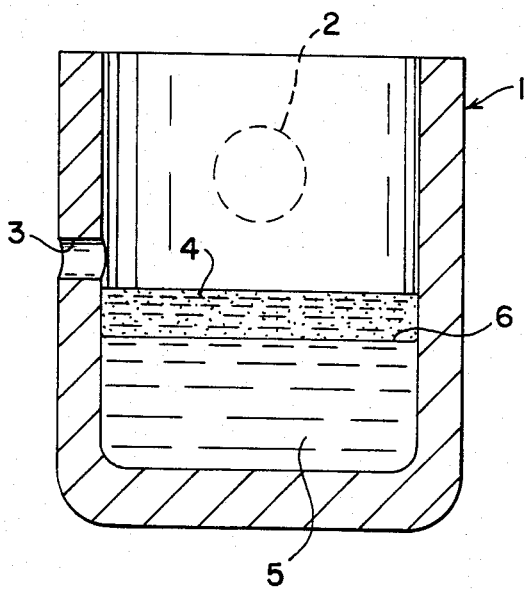
FIG. 1 is a schematic cross-sectional view, taken at right angles to the trunion centerline, of a substantially cylindrical steelmaking vessel at the completion of a heat.

The operation of the process may be understood more fully by reference to the drawing. FIG. 1 shows a steelmaking vessel 1 mounted on trunions 2, having a taphole 3 in the wall of the vessel positioned below the centerline of trunions 2 but above the uppermost surface of the slag 4. Slag 4 forms a layer which floats on steel 5, forming an interface 6 between the layers, due to the differences in density between the two liquids.

Figure 2:
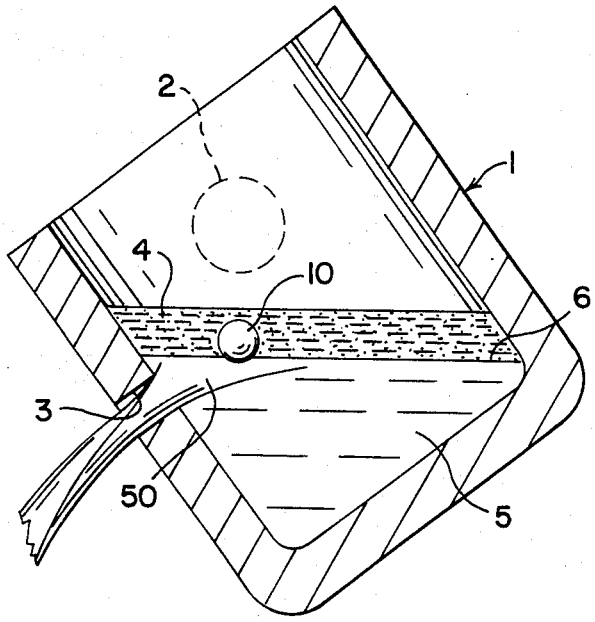
FIG. 2 (PRIOR ART)
FIG. 2 is a schematic cross-sectional view, taken at right angles to the trunion centerline, of the tapping of a steelmaking vessel, utilizing a taphole, with the prior art technique utilizing at least one discrete piece of heat-stable material.

FIG. 2 illustrates the prior art tapping process utilizing a discrete, substantially spherical piece of heat-stable material 10, which has a density such that it floats substantially at interface 6 between the slag and steel layers. The sphere 10 starts at the position near the interface 6 as illustrated in FIG. 2, but eventually is drawn by vortex 50 into taphole 3, where it blocks off the flow of the steel from the vessel prematurely. The only way to delay this and minimize the residuum of untapped steel in the vessel is to manipulate the tilt of the vessel from the vertical to maintain a slow flow of steel, to minimize the formation and power of the vortex.

Figure 3:
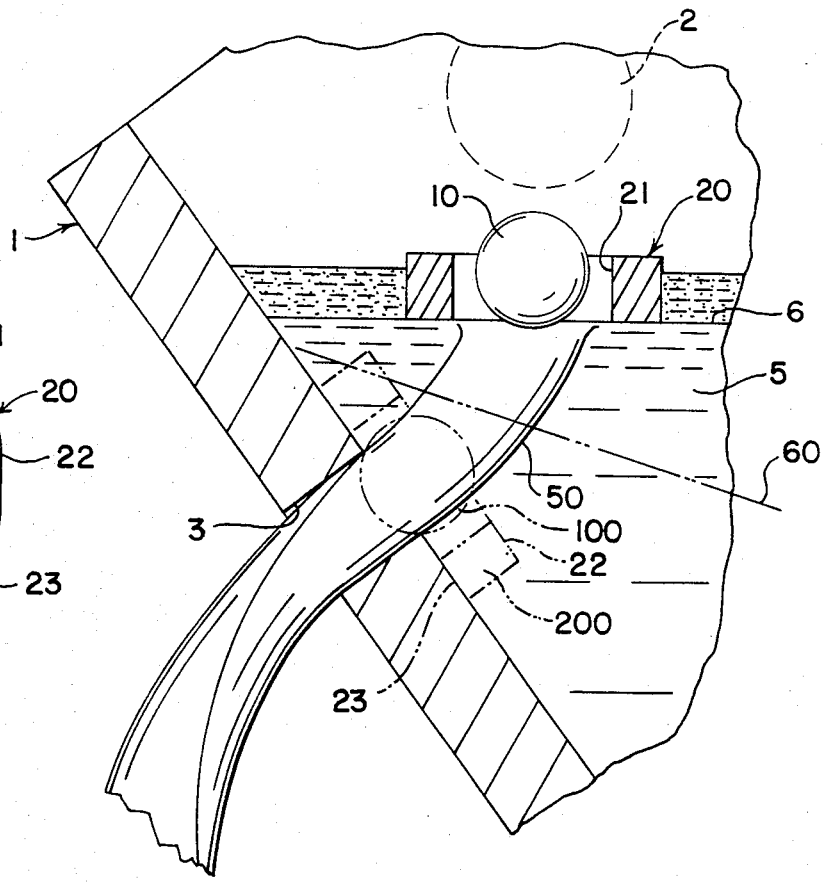
FIG. 3 is an enlarged schematic view showing use of the invention.
Figure 4:
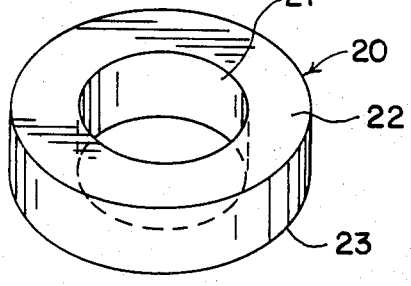
FIG. 4 is a perspective view of the article of the invention.

FIG. 3 illustrates the use of annular disc 20 according to the invention, while FIG. 4 illustrates a disc 20 itself. The disc contains an annular passage 21 connecting the opposing faces 22, 23. The diameter of passage 21 should be equal to or greater than that of the taphole, and, if a discrete sphere 10 is also utilized, greater than that of said sphere as well. The particular diameter chosen should be such as to allow the desired rate of steel flow from the vessel without impediment by the heat-stable material. The presence of the passage making up part of the peripheral boundary of the annular disc 20 is to provide for the self-centering of disc 20 in vortex 50, which will occur due to the passage 21.

The solid portions of FIG. 3 show the location of a discrete piece of heat-stable material, sphere 10, at the interface 6, and of the annular disc 20, during the predominance of the tapping period. Disc 20 centers itself, through the dynamics of the fluid flow with vortex 50, over the vortex and against interface 6, substantially above steel 5. Sphere 10 in turn substantially centers itself in passage 21 of disc 20. Liquid steel flows through passage 21 and around and under disc 20 into and through tap hole 3, the disc serving to resist the vortex 50's drawing-in of sphere 10. As the interface 6 shifts from its initial position to its final position as steel is removed from the vessel, that final position being shown as interface 60, the disc 20 and sphere 10 also shift from their initial position to their final positions, shown in the dotted portions of FIG. 3 as disc 200 and sphere 100. The movement between initial and final positions does not alter the position of disc 20 with respect to sphere 10 and vortex 50—the disc 20 remains around the sphere and between it and the vortex, continuing to resist the vortex's flow. The disc 20 is diametrically sized so as to being slightly larger than the maximum diameter of vortex 50, which prevents leaking of the vortex flow around the disc to sphere 10.

By the time the disc assumes final position 200, the interface 6 has also moved to position 60, and the major portion of the liquid steel has been tapped. The force of vortex 50 draws the disc against the inside of the vessel wall bearing the taphole, which restricts liquid steel flow to passage 21. The resulting force of the flow through the decreased depth of the molten materials in the vessel draws sphere 10 into its final position 100.

It may readily be seen that disc 20 is far superior to the discrete sphere 10 in resisting the vortex 50's force and maintaining its buoyancy at the slag 4/steel 5 interface 6. This results in the passage of far more steel through taphole 3 before the sphere is finally drawn in to close the taphole, allowing the steelmaker to leave far less of a residuum of steel in with the molten slag. Furthermore, when the flow is finally closed-off, far less slag passes through the tap hole when annular disc 20 is used than when it is not.

Figure 5:
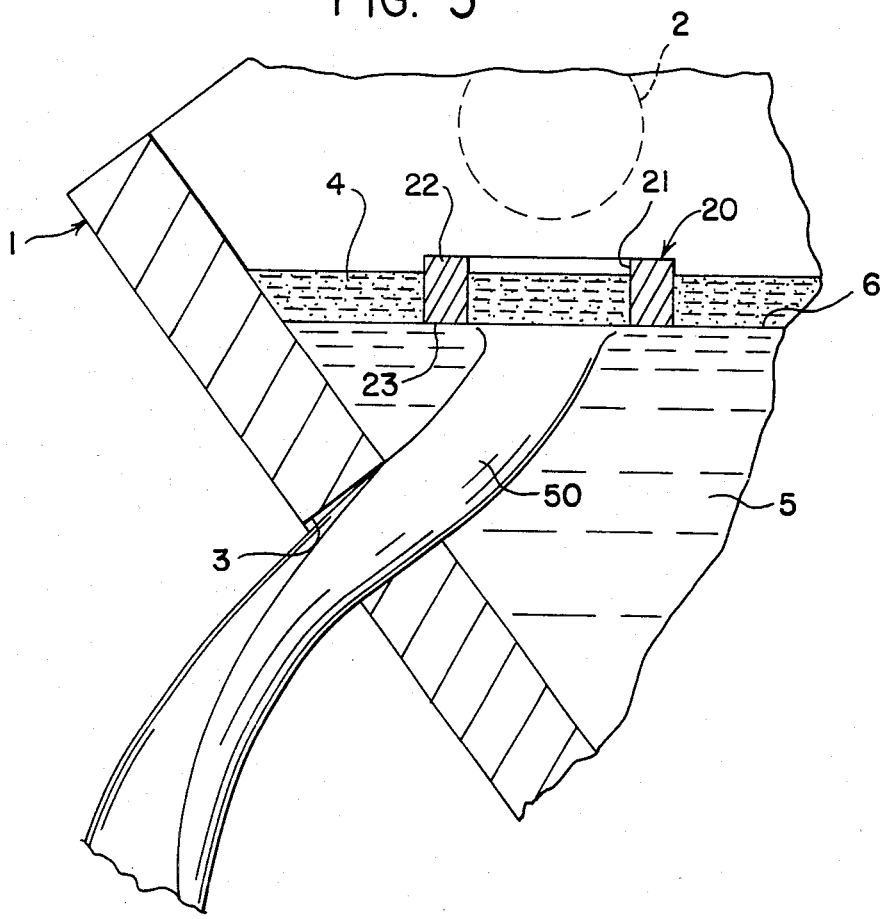
FIG. 5 is an enlarged schematic similar to FIG. 3. showing another use of the inventory.

Disc 20 can also eliminate or greatly diminish slag carry over during tapping or casting when used alone, as illustrated in FIG. 5. Disc 20 is dimensioned so as to be greater in the dimension between opposing faces 22, 23 than the depth of the layer of slag 4. As a result, it functions as a dam to prevent slag from flowing through taphole 3, other than that small quantity of slag initially encompassed by passage 21. Disc 20, as in the FIG. 3 embodiment, is drawn down to a final position against the inside of the vessel wall bearing the taphole; tapping is stopped when slag flow commences through taphole 3.

While particular embodiments of the invention, and the best mode contemplated by the inventor for carrying out the invention, have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

I claim:

1. In a steelmaking process in which a layer of liquid slag is formed on the liquid steel in the steelmaking vessel during said process, whereafter at the completion of the heat said liquid steel is removed from said vessel through a side taphole, the improvement comprising the addition to said vessel prior to tapping of a spatially unconstrained, heat-stable material having a density such that said material floats substantially at the interface between said slag and said steel and effects unrestricted spatial movement with respect to said interface and said taphole during tapping, said material being in the physical form of at least one annular disc.

2. The process of claim 1 wherein the surface of said annular disc is toroidal in shape.

3. The process of claim 1 wherein said steelmaking process comprises a basic oxygen steelmaking process, an electric furnace process, or a process utilizing a caster tundish.

4. The process of claims 1, 2 or 3 wherein there is further added to said vessel at least one additional discrete piece of heat-stable material prior to tapping.

5. The process of claim 4 wherein said additional discrete piece is substantially spherical in shape.

* * * * *